US005119141A

United States Patent [19]

Bhagat

[11] Patent Number: 5,119,141

[45] Date of Patent: Jun. 2, 1992

[54] ELECTROSTATIC ROLLER TRANSFER OF TONED IMAGES FROM A PHOTOCONDUCTOR MEMBER TO A SHEET SUBSTRATE

[75] Inventor: Gopal C. Bhagat, Houston, Tex.

[73] Assignee: Compaq Computer Corporation, Houston, Tex.

[21] Appl. No.: 648,184

[22] Filed: Jan. 31, 1991

[51] Int. Cl.[5] ..... G03G 15/16

[52] U.S. Cl. ..... 355/274

[58] Field of Search ..... 355/205, 274, 215; 430/126

[56] References Cited

U.S. PATENT DOCUMENTS

| | | | |
|---|---|---|---|
| 3,924,943 | 12/1975 | Fletcher | 355/274 |
| 4,338,017 | 7/1982 | Nishikawa | 355/274 X |
| 4,382,673 | 5/1983 | Nakajima et al. | 355/274 |
| 4,947,215 | 8/1990 | Chuang | 355/274 |

FOREIGN PATENT DOCUMENTS

| | | | |
|---|---|---|---|
| 0237475 | 11/1985 | Japan | 355/274 |
| 0251068 | 10/1989 | Japan | 355/274 |
| 1-265282 | 1/1990 | Japan . | |

*Primary Examiner*—Joan H. Pendegrass
*Assistant Examiner*—Patrick J. Stanzione
*Attorney, Agent, or Firm*—Johnson & Gibbs

[57] ABSTRACT

An electrically biased attracter roller is utilized in an electrophotographic image reproduction machine, in place of a conventional corotron device, to electrically transfer toner from the side of a rotating photoconductor drum onto a side surface of paper stock being operatively fed through the machine. The charged roller is spring-biased into forcible side-to-side engagement with the drum and is frictionally rotated by the drum. The paper stock is fed between the rotating roller and drum and, by a combination of pressure and electrical attractive force, the roller very efficiently transfers toner from the drum to the paper. To further improve the overall effectiveness of the attracter roller, a humidity compensation system is provided and is operative to automatically adjust the bias voltage of the roller, and thus the electrical toner attraction force thereof, in response to sensed humidity variations within the machine housing.

10 Claims, 2 Drawing Sheets

ELECTROSTATIC ROLLER TRANSFER OF TONED IMAGES FROM A PHOTOCONDUCTOR MEMBER TO A SHEET SUBSTRATE

BACKGROUND OF THE INVENTION

1. Field of the Invention

The present invention relates generally to printing and copying devices, and more particularly relates to the transfer of toner from a rotating photoconductor drum to paper stock being operatively fed through an electrophotographic printer or copier.

2. Description of Related Art

In conventional electrophotographic image reproduction machines, such as printers and copiers, a toner material is depicted onto discharged side surface portions of an otherwise negatively charged rotating photoconductor drum. As these toner-covered drum surface portions are rotated into close adjacency with a side surface of a sheet of paper being fed through the machine, toner from the discharged "image" areas of the drum is electrically drawn onto the paper by a positively charged corotron device positioned adjacent the opposite side of the paper sheet. The sheet is then passed through a heating device which thermally fuses the transferred toner to the paper.

While corotron devices are the conventional and widely accepted means for electrically transferring toner from the photoconductor drum to the paper stock to be toner-imprinted, they are sulot to a variety of well-known problems, limitations and disadvantages. For example, corotrons generate ozone during their operation, thereby creating a potential health hazard for operators of the machines into which they are incorporated. Additionally, corotrons require relatively large amounts of power since their electrical attraction force, which draws toner from the photoconductor drum onto the paper sheet, is created by ionizing the air disposed in the gap between the corotron and the photoconductor drum.

Another limitation associated with the use of corotrons in this application is that they are relatively inefficient in transferring toner from the drum to the paper. For example, of the total quantity of toner deposited on the drum for a given sheet to be printed only about 70–75% is actually transferred to the paper by the typical corotron the toner remaining on the drum after the sheet has been printed is automatically scraped off the drum, dropped into a toner collection housing, and later discarded.

This relatively low toner transfer efficiency of the typical corotron tends to degrade over time, in a relatively rapid fashion, due to unavoidable contamination of the corotron charge wire by dust, moisture and stray toner particles which tend to settle on and adhere to the wire during off periods of the machine. Stray toner and dust settling onto the corotron shield structure over time also tend to undesirably rub off onto the backsides of paper sheet being fed through the machine, leaving unsightly streaks on the paper stock exiting the machine.

As is well known, corotron-based electrophotographic image reproduction machines, such as printers and copiers, are quite susceptible to print quality fluctuations occasioned by changes in ambient air humidity. The usual method of compensating for these print quality fluctuations is to make trial-and error manual adjustments of the "light/dark" setting on the machine until satisfactory print quality is achieved. This manual machine adjustment to compensate for humidity fluctuations is, of course, wasteful of time, energy, paper and toner.

It can readily be seen from the foregoing that it would be desirable to provide improved drum-to-paper toner transfer apparatus and methods in electrophotographic image reproduction machinery which eliminate or at least substantially reduce the above-mentioned problems, limitations and disadvantages heretofore associated with the use of toner transfer corotrons. It is accordingly an effect of the present invention to provide such improved apparatus and methods.

SUMMARY OF THE INVENTION

In carrying out principles of the present invention, invention, in accordance with a preferred embodiment thereof, the corotron device conventionally used to electrically attract toner from a rotating, electrically charged photoconductor drum onto a sheet of paper stock being operatively fed through an electrophotographic image reproduction machine, such as a printer or copier, is replaced with an electrostatically chargeable attracter roller structure.

The roller structure is petitioned in a parallel, side-to-side relationship with the drum and is resiliently biased into forcible engagement therewith so that the driven rotation of the drum frictionally drives the roller structure in an opposite rotational direction During rotation of the roller structure and drum an electrical bias, of opposite polarity from the drum charge polarity, is imparted to the roller structure and the paper stock being fed through the machine is passed between and through the counter-rotating roller structure and As a given sheet of paper stock passes between the roller structure and drum toner is very efficiently transferred from the toner-covered side surface "image" areas of the drum to the side of the sheet facing the drum by a unique contamination of mechanical pressure force and electrical attraction force. Specifically, the roller structure forcibly presses the paper sheet against the drum image areas while the oppositely charged roller structure electrically drives toner from the drum onto the pressed sheet.

Compared to the corotron device which it uniquely replaces, the attractor roller provides a variety of very desirable advantages For example, during operation it does not create any detectable amount of ozone, it consumes considerably less power than a corotron, and it provides a significantly increased drum-to-paper toner transfer efficiency. Additionally, the attracter roller's toner transfer efficiency is less susceptible to degradation over time, and the roller is less prone to smear the back side of the paper with toner which has settled on the roller during idle periods of the machine.

According to a feature of the present invention, the attractor roller structure is electrically biased to a selectively variable voltage, and humidity compensation means are provided for varying the magnitude of such voltage in response to sensed variations in the ambient air humidity to which the toner is exposed. In this manner the electrical toner attraction force of the roller structure is automatically varied as a predetermined function of sensed humidity to reduce print quality fluctuation caused by changes in humidity.

BRIEF DESCRIPTION OF THE DRAWINGS

FIG (PRIOR ART) is a highly schematic cross-sectional view through a representative laser printer in which a transfer corotron device is utilized to electrically attract toner from the side of a rotating photoconductor drum onto a side surface of paper stock being operatively fed through the printer.

DETAILED DESCRIPTION

Figure 1:
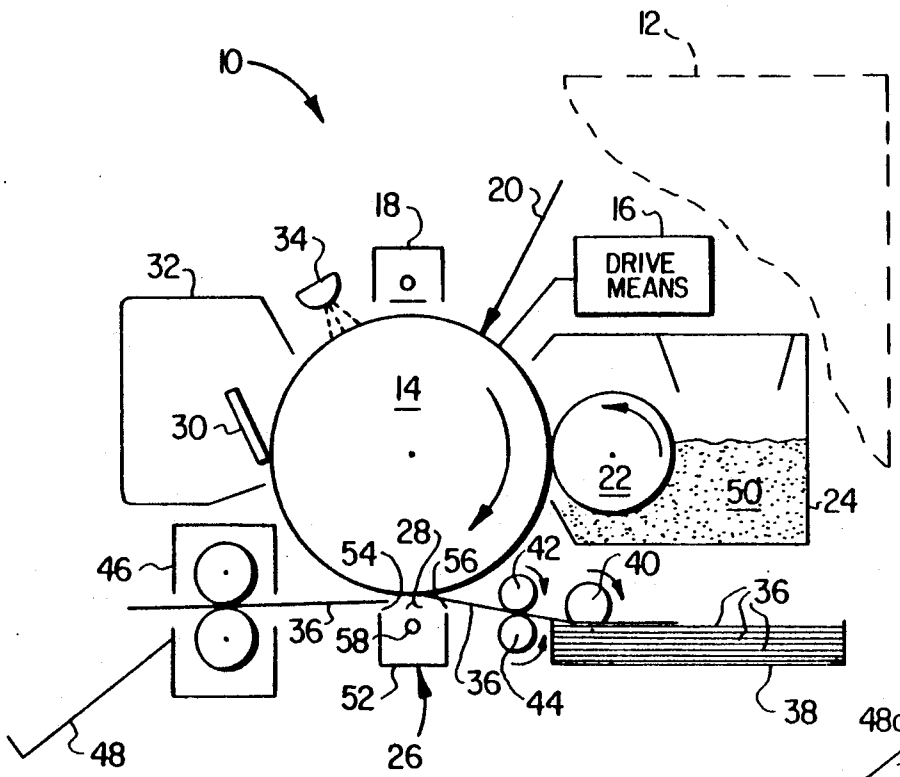
FIG. 1 (PRIOR ART)

Schematically illustrated in FIG. 1 is a conventional electrophotographic image reproduction machine, representatively in the form of a laser printer 10, which includes a housing 12 within which a photoconductor drum 14 is rotationally driven, in the illustrated clockwise direction by suitable drive means 16. During driven rotation of the drum 14, each circumferential outer side portion thereof is sequentially passed by a scorotron charging unit 18, a digitally controlled laser beam 20, a rotating magnetic brush roller 22 disposed in a developer sump 24, a transfer corotron 26 downwardly separated from the bottom side of the drum by an air gap 28, the scraper blade portion 30 of a toner collection housing 32, and a discharge lamp 34.

While the drum 14 is rotating, paper sheets 36, from a stack thereof supported in a suitable paper tray 38, are fed leftwardly through the housing 12 by a conventional paper feed system which includes a paper feed roller 40 having a generally D-shaped cross section, and a pair of counter-rotating registration pinch rollers 42 and 44. The indicated clockwise driven rotation of the feed roller 40 moves the top paper sheet in the stack thereof leftwardly to between the pinch rollers 42, 44 which drive the sheet leftwardly through the corotron air gap 28. In a manner subsequently described, a toner material is transferred to the top side of the paper sheet passing leftwardly through the corotron gap to form the desired image on the sheet The printed sheets 36 leftwardly exiting the corotron gap 28 are passed through a conventional hot pressure roll fuser 46 which operates to thermally and mechanically fuse the applied toner passing through the fuser. The printed sheets exiting the fuser 46 drop into a suitable printed paper collection tray 48.

The operation of the rotating drum 14 is conventional, and will now be briefly described. As each circumferential outer side surface portion of the drum 14 passes under the charging unit 18, it is negatively charged, and when the drum surface portion passes beneath the incoming laser beam 20, certain portions thereof are caused to be discharged, thereby forging the "image" areas of the drum surface which will later create the darkened image areas on the leftwardly moving paper stock 36. As the drum surface portion is rotated past the counter-rotating magnetic roller 22, the roller 22 operates to deliver a quantity of developer 50, disposed within the sump 24, into adjacency with the drum side surface portion The negatively charged drum side surface portion attracts a quantity of toner constituent from the developer material onto the image areas of the drum The toner-covered image areas on the drum side surface portion are then rotated to a position directly above the transfer corotron 26. The corotron 26 operates to create a positive charge in the air gap 28 which, as a given paper sheet 36 passes leftwardly through the gap, electrically attracts toner from the image areas onto the top side of the paper sheet as previously described.

As the drum side surface portion is rotated past the corotron 26, residual toner is scraped away from the surface portion by the blade 30, with the scraped-away toner falling into the collection housing 32 Finally, as the now cleaned drum side surface portion passes under the lamp 34, the side surface portion is electrically discharged and is thus readied for uniform re-charging by the scorotron 18 for the next image cycle The transfer corotron 26 comprises a generally trough-shaped shield structure 52 having a top side opening which faces the underside of the drum 14 and is bounded along its length by a pair of top side edges 54 and 56. Extending longitudinally along the interior of the shield 52, adjacent its open top side, is a wire element 58 which, during machine operation, is positively charged to create the electrical attraction force which draws toner downwardly from the rotating drum 14 onto the top sides of paper sheets 36 leftwardly passing through the corotron gap 28.

Although conventional and widely used to transfer toner from photoconductor drums to paper stock in eleotrophotographio image reproduction machines, the corotron 26 is subject to a variety of well-known problems, limitations and disadvantages. For example, because the corotron 26 creates its electrical toner attraction force by ionizing the air gap 28, it undesirably creates ozone which constitutes a potential health hazard to operators of the machine 10. Additionally, the corotron 26 has a relatively high power consumption its wire 58 typically being charged to a positive voltage on the order of 5,000 volts.

Additionally, despite this high operating voltage, the corotron 26 is not particularly efficient in its task of electrically transferring toner from the drum 14 to the paper sheets 36. For example, when newly installed, a transfer corotron such as the corotron 26 is typically able to attract onto a paper sheet only about 70% to 75% of the toner deposited upon the drum and available for transfer to a particular paper sheet 36. The remaining 25% to 30% of the toner remaining on the drum after imprintation of the sheet 36 is scraped away by the blade 30, deposited in the housing 32, and effectively wasted This initially low toner transfer efficiency associated with the conventional corotron 26 also tends to rather quickly diminished by contamination of its charging wire 58 caused by deposition thereon of dirt, moisture, dust and stray toner occurring during off periods Of the machine.

Dust, dirt, moisture and stray toner within the housing 12 also tend to settle on the uncharged upper side edge portions 54, 56 of the corotron shield 52 during off periods of the machine This dust, dirt and toner on the edges 54, 56 tends to he undesirably wiped off onto the backsides of the sheets 36 later traversing the corotron gap 28 during machine operation, thereby causing unsightly streaking on the sheets.

Another problem inherent in the conventional machine 10, due to its utilization of the transfer corotron 26, is its susceptibility to image quality fluctuations occasioned by changes in ambient air humidity to which the toner is exposed within the housing 12. More specifically, the effective electrical toner attraction force of the constant voltage corotron 26, and thus its toner transfer efficiency, is undesirably caused to fluotuate in response to humidity changes. The usual method of compensating for these print quality variations is a trial-and-error manual adjustment of the machine's "light-/dark" image controls which causes both printing time delays and paper wastage.

Figure 2:
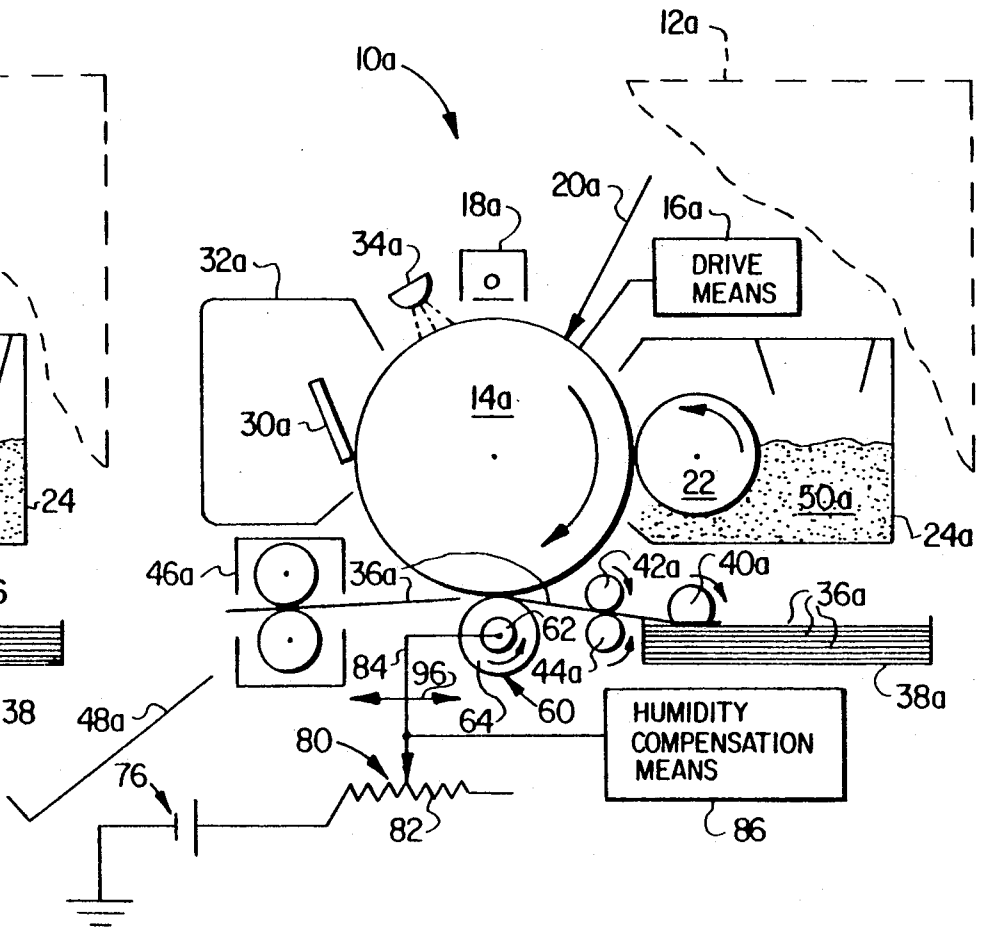
FIG. 2 is a highly schematic cross-sectional view through a representative improved laser printer which embodies principles of the present invention and utilizes an electrostatically charged attracter roller, in place of the transfer corotron shown in FIG. 1, to more efficiently effect the transfer of toner from the photoconductor drum to the paper stock being fed through the printer.

Referring now to FIG. 2, the present invention provides an improved electrophotographic image reproduction machine, representatively in the form of a laser printer $\mathbf{10}_a$, in which the above-mentioned transfer corotron problems, limitations and disadvantages are substantially done away with by eliminating the corotron 26 and replacing it with an electrostatically chargeable attracter roller structure 60 Except for its unique drum-to-paper toner transfer structure and operation, which will he subsequently described in detail, the machine 10*a* is identical in construction and operation to the conventional machine 10 in FIG. 1. Accordingly, for ease in comparison, the components in the improved machine 10*a* identical to those in the conventional machine 10 have been given the same reference numerals to which the subscripts "a" have been added.

Figure 3:
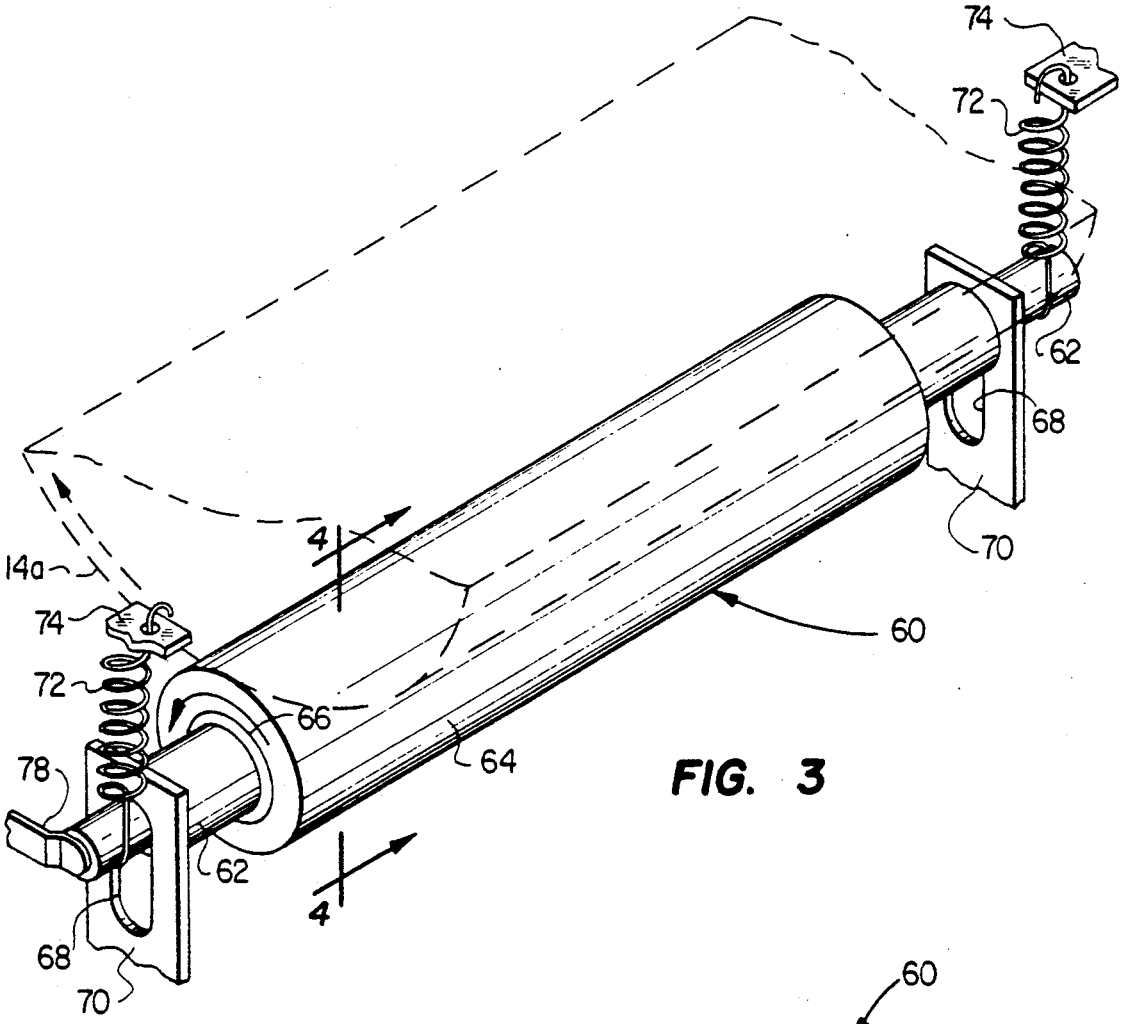
FIG. 3 is an enlarged scale perspective view of the attractor roller and representative support apparatus associated therewith.
Figure 4:
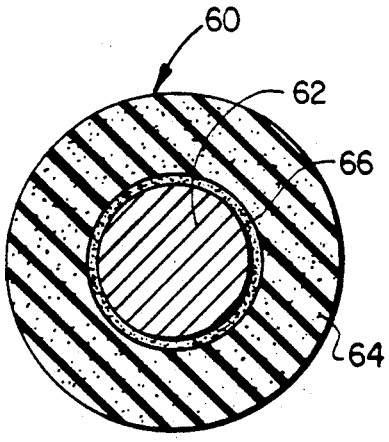
FIG. 4 is an enlarged scale cross-sectional view through the attracter roller taken along line 4—4 of FIG. 3.

As best illustrated in FIGS. 3 and 4, the attractor roller structure 60 includes an elongated, electrically conductive shaft 62 (representatively metal) which is coaxially circumscribed by a tubular. Radially outer roller body 64 fixedly secured to the shaft 62 by a suitable electrically conductive adhesive material 66 (or molded integrally with the shaft) The roller structure 60 is disposed beneath and longitudinally parallel to the underside of the drum $\mathbf{14}_a$, with the outer ends of the roller shaft 62 being captively retained in vertical slots 68 formed in suitable lower support structures 70. The semiconductive outer roller body 64 is resiliently biased upwardly into forcible contact with the underside of the drum $\mathbf{14}_a$ (representatively with a contact force of from about 0.5 lbs. to about 2.0 lbs.) by means of two tensioned coil spring members 72 (FIG. 3) connected at their opposite ends to the outer shaft ends and suitable upper support structures 74. As illustrated, the frictional engagement between the roller body 64 and the underside of the rotating drum $\mathbf{14}_a$ causes the roller structure 60 to be frictionally rotated in a counterclockwise direction by the rotationally driven drum $\mathbf{14}_a$, with no slippage between drum $\mathbf{14}_a$ and the roller structure 60.

The illustrated roller body 64 is formed from a resilient, generally electrically semiconductive foam material such as that manufactured by the Uniroyal Corporation under the tradename "ENSOLITE CEC FOAM". However, other electrostatically chargeable resilient foam materials, such as urethane foam, could be utilized if desired. Additionally, solid electrostatically chargeable materials, such as rubber or neoprene, could also be utilized to form the roller body 64, if desired Referring now to FIGS. 2 and 3, the attracter roller structure 60 is electrostatically charged to a selectively variable positive voltage (representatively within the range of +300 volts to +500 volts) by a conventional grounded DC power source 76 connected to the roller structure 60 by a copper contact strip 78 (FIG. 3) which slidably engages one end of the roller shaft 62, and a rheostat 80 interposed between the power source 76 and the contact strip 78. The rheostat 80 has a stationary resistor portion 82 operatively engaged by a movable contact member 84

During operation of the improved machine $\mathbf{10}_a$, the paper sheets $\mathbf{36}_a$ are feed between and through the forcibly engaged, oppositely charged drum $\mathbf{14}_a$ and roller body 64 As each sheet $\mathbf{36}_a$ passes through the roller body and drum, it has toner transferred from the drum to its top side by a unique contamination of mechanical pressure force exerted on the sheet by the roller body 64, and an electrical attraction force, exerted by the positively charged roller body 64, which electrically attracts toner from the drum onto the top side of the sheet. The spring elements 72 resiliently maintain the mechanical pressure force on the paper sheet $\mathbf{36}_a$ and also automatically compensate for differences in the thickness of the particular paper stock by permitting the roller structure 60 to be driven slightly downwardly when thicker paper stock is encountered.

The use of the electrostatically chargeable roller structure 60 in place of the conventional transfer corotron 26 shown in FIG. 1 provides the improved electrophotographic image reproduction machine 10*a* (which may be a printer, as illustrated, or a copier) with a variety of operating advantages For example, unlike the corotron 26, the positively charged roller structure 60 does not generate any detachable amount of ozone during its operation Additionally, since the charge magnitude on the roller structure 60 is only about 10% of that required for the corotron 26, the roller structure 60 has a substantially lower power requirement.

Compared to the corotron 26, the attracter roller structure 60 also (when initially installed in the machine $\mathbf{10}_a$) has a substantially higher toner transfer efficiency, despite its lower power requirement. This initial toner transfer efficiency of the roller structure is approximately within the range of from about 90% to about 95%. It has been found in developing the present invention that this initially high toner transfer efficiency of the roller structure 60 is considerably less susceptible to degradation, due to toner and dirt buildup on the roller, than that associated with the corotron 26. Accordingly, the overall high image quality operating life of the roller structure 60 can be expected to be considerably longer than that of the corotron 26.

Moreover, the roller structure 60 does not tend to streak the back sides of the paper sheets $\mathbf{36}_a$ as world the corotron 26 While the exact mechanism of this particular advantage is not fully understood at the present time, it is hypothesized that it arises from the fact that during operation of the roller structure 60 all of the portion thereof which contacts the back sides of the paper sheets $\mathbf{36}_a$ is positively charged and thus firmly adheres residual toner and dust (previously settling on the roller body 64) to the roller structure, thus preventing the residual dust and toner from being undesirably transferred to the backsides of the paper sheets According to another feature of the present invention, image quality degradation arising from changes in humidity is substantially reduced by the provision in the improved machine $\mathbf{10}_a$ of the schematically depicted humidity compensation means 86 shown in FIG. 2 The humidity compensation means 86 function to automatically vary the positive charge voltage on the roller structure 60, in response to sensed variations in the ambient air humidity to which the toner within housing $12_a$ is exposed, by adjusting the setting of the rheostat 8.0. This automation adjustment of the rheostat 80 accordingly maintains a predetermined relationship between the sensed ambient air humidity and the positive electrostatic charge voltage on the roller structure 60 to substantially diminish undesirable humidity-related fluctuations in image quality on the printed paper sheets $36_a$ delivered to the paper collection tray $48_a$.

Figure 5:
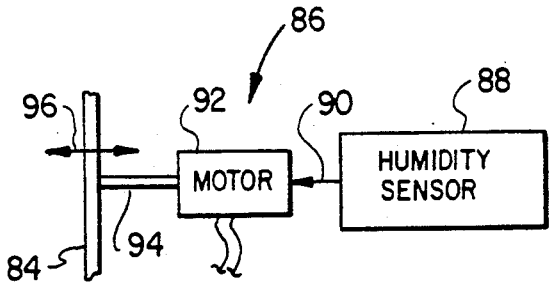
FIG. 5 is a schematic diagram of representative components used to form the humidity compensation means schematically incorporated in the FIG. 2 printer.

While a variety of systems and components could be utilized to maintain this predetermined relationship between sensed humidity and the magnitude of the positive charge voltage on the roller structure 60, a representative system is schematically depicted in FIG. 5 and includes a suitable humidity sensor 88 disposed within the housing $12_a$. The humidity sensor 88 is operative to transmit an output signal 90, indicative of the sensed ambient air humidity, to a small electric motor 92 having a linearly drivatle output shaft 94 connected to the movable contact member portion 84 of the rheostat 80. Driven axial movement of the shaft 94, as controlled by the humidity sensor 88, is operative to correspondingly translate the contact member 84, as indicated by the double-ended arrow 96, to appropriately adjust the rheostat 80, and thus the charge voltage of the attracter roller structure 60.

The foregoing detailed description is to be clearly understood as being given by way of illustration and example only, the spirit and scope of the present invention being limited solely by the appended claims

What is claimed is:

1. Apparatus for transferring toner from the side of an electrically charged photoconductor drum to a side surface of a sheet of paper stock in an electrophotographic image reproduction machine, such as a printer or copier, said apparatus comprising:

an electrostatically chargeable attracter roller structure;

support means for positioning said roller structure in a parallel, side-to-side relationship with said drum, and for creating a predetermined lateral contact force between said roller structure and said drum;

charging means for supplying an electrical via voltage to said roller structure of a polarity opposite from the charge polarity of said drum, said charging means including a DC power source operatively connected to said electrostatically chargeable attracter roller structure through a rheostat;

drive means for selectively causing a simultaneous rotation of said roller structure and said drum in opposite directions; and means for varying the magnitude of said electrical bias voltage supplied to said attracter roller structure, in a manner compensating for variations in the ambient air humidity to which the toner is exposed, by using a motor to automatically charge the setting of said rheostat in response to sensed variations in the ambient air humidity to which the toner is exposed.

2. The apparatus of claim 1, wherein said attracter roller structure includes:

a shaft formed from an electrically conductive material, and an annular, radially outer body portion coaxially secured to and circumscribing said shaft, said body portion being formed from a generally electrically semiconductive material.

3. The apparatus of claim 2 wherein:

said body portion is secured to said shaft by a conductive adhesive material.

4. The apparatus of claim 2 wherein:

said body portion is formed from a resilient foam material.

5. The apparatus of claim 2 wherein:

said charging means are operative to charge said shaft.

6. The apparatus of claim 1 wherein:

said support means include spring means for resiliently biasing said roller structure into contact with said drum.

7. The apparatus of claim 1 wherein:

said drive means include means for rotationally driving said drum, and said roller is frictionally drivable by said drum.

8. An electrophotographic image reproduction machine comprising:

a housing;

means for moving an imprintable medium through said housing;

rotationally drivable photoconductor drum means having a side surface portion operatively chargeable, during rotation of said drum means, to electrostatically attract and hold a quantity of toner and rotationally transport the quantity of toner into adjacency with the imprintable medium for transfer thereto;

means for operatively charging said drum means side surface portion;

means for providing a supply of toner from which said quantity of toner may be electrostatically attracted onto said drum means side surface portion;

transfer means operable to transfer toner from said drum means side surface portion onto the moving imprintable medium, said transfer means including:

a transfer roller laterally pressed into engagement with said side surface portion of said photoconductor drum means, and means, including a DC power source connected to said transfer roller through a rheostat, for supplying a selectively variable electrical bias voltage to said transfer roller; and humidity compensation means for varying the magnitude of said electrical bias voltage supplied to said transfer roller in response to sensed variations in ambient air humidity to which the toner is exposed, said humidity compensation means including:

means, including a motor, for automatically adjusting the setting of said rheostat in response to sensed variations in the ambient air humidity to which the toner is exposed, humidity compensation means for varying the magnitude of said electrical bias voltage supplied to said transfer roller in response to sensed variations in ambient air humidity to which the toner is exposed.

9. A method of transferring toner from an external surface portion of a toner carrying member to a side surface portion of a sheet member to be imprinted in an electro-photographic image reproduction machine, said method comprising the steps of:

pressing the sheet member between the external surface portion of the toner carrying member and an electrically chargeable roller member;

imparting a bias voltage to said roller by operatively connecting a DC power source thereto through a rheostat; and compensating for variations in ambient air humidity by using a motor to automatically adjust the setting of said rheostat in response to sensed changes in the ambient air humidity to which the toner is exposed.

10. Apparatus for transferring toner from an external surface portion of a toner carrying member to a side surface portion of a sheet ember to be imprinted in an electro-photographic image reproduction machine, said apparatus comprising:

an electrically chargeable attracter member;

means for pressing the sheet member between the toner carrying member and said attracter member;

a DC power source connected to said attracter member through a rheostat and operative to impart a toner-attracting bias voltage to said attracter member; and means for compensating for changes in ambient air humidity, said means for compensating including:

means, including a motor, for automatically changing the setting of said rheostat in response to sensed variations in the ambient air humidity to which the toner is exposed.

* * * * *

UNITED STATES PATENT AND TRADEMARK OFFICE

CERTIFICATE OF CORRECTION

PATENT NO. : 5,119,141

DATED : June 2, 1992

INVENTOR(S) : Gopal C. Bhagat

It is certified that error appears in the above-identified patent and that said Letters Patent is hereby corrected as shown below:

Column 1, line 30, "sulot" should be --subject--.
Column 1, line 47, " the" should be --. The--.
Column 2, line 12, "effect" should be --object--.
Column 2, line 18, delete the second invention.
Column 2, line 26, "petitioned" should be --positioned--.
Column 2, line 30, add --.-- after direction.
Column 2, line 35, add --drum.-- after and.
Column 2, line 37, add --,-- after drum.
Column 2, line 40, "contamination" should be --combination--.
Column 2, line 48, "attractor" should be --attracter".
Column 2, line 49, add --.-- after advantages.
Column 2, line 59, "attractor" should be --attracter".
Column 3, line 3, add --1-- after FIG.
Column 3, line 18, "attractor" should be --attracter--.
Column 3, line 33, add --,-- after direction.
Column 3, line 55, add --.-- after sheet.
Column 3, line 68, "forging" should be --forming--.
Column 4, line 7, add --.-- after portion.
Column 4, line 10, add --.-- after drum.
Column 4, line 21, add --.-- after 32.
Column 4, line 39, "eleotrophotographio" should be --electrophotographic--.
Column 4, line 46, add --,-- after consumption.
Column 4, line 60, add --.-- after wasted.
Column 4, line 61, add --be-- after to.
Column 4, line 65, "Of" should be --of--.
Column 5, line 1, add --.-- after machine.
Column 5, line 2, "he" should be --be--.
Column 5, line 13, "fluotuate" should be --fluctuate--.
Column 5, line 26, add --.-- after 60.
Column 5, line 28, "he" should be --be--.
Column 5, line 35, "attractor" should be --attracter--.

UNITED STATES PATENT AND TRADEMARK OFFICE

CERTIFICATE OF CORRECTION

PATENT NO. : 5,119,141

DATED : June 2, 1992

INVENTOR(S) : Gopal C. Bhagat

It is certified that error appears in the above-identified patent and that said Letters Patent is hereby corrected as shown below:

Column 5, line 38, delete "." after tubular and insert --,-- and "Radially" should then be --radially--.
Column 5, line 41, add --.-- after ")".
Column 5, line 66, add --.-- after desired.
Column 6, line 9, add --.-- after 84.
Column 6, line 13, add --.-- after 64.
Column 6, line 15, "contamination" should be --combination--.
Column 6, line 31, add --.-- after advantages.
Column 6, line 33, "detachable" should be --detectable--.
Column 6, line 34, add --.-- after operation.
Column 6, line 53, "world" should be --would--.
Column 6, line 54, add --.-- after 26.
Column 6, line 63, add --.-- after sheets.
Column 6, line 68, add --.-- after 2.
Column 7, line 6, "automation" should be --automatic--.
Column 7, line 22, "drivatle" should be --drivable--.
Column 7, line 33, add --.-- after claims.
Column 7, line 47, "via" should be --bias--.
Column 7, line 61, "charge" should be --change--.
Column 8, line 59, "exposed," should be --exposed.--.

UNITED STATES PATENT AND TRADEMARK OFFICE

CERTIFICATE OF CORRECTION

PATENT NO. : 5,119,141

DATED : June 2, 1992

INVENTOR(S) : Gopal C. Bhagat

It is certified that error appears in the above-indentified patent and that said Letters Patent is hereby corrected as shown below:

Column 8, line 60, delete "humidity compensation means...the toner is exposed.".

Signed and Sealed this

Thirty-first Day of August, 1993

*Attest:*

*Attesting Officer*

BRUCE LEHMAN

*Commissioner of Patents and Trademarks*